United States Patent [19]

LeMaster

[11] Patent Number: 4,730,668

[45] Date of Patent: Mar. 15, 1988

[54] RADIATOR ADAPTOR AND ASSEMBLY

[76] Inventor: William LeMaster, 1207 George St., Peoria, Ill. 61605

[21] Appl. No.: 14,687

[22] Filed: Feb. 13, 1987

[51] Int. Cl.[4] ..... F28F 7/00

[52] U.S. Cl. ..... 165/137; 165/148

[58] Field of Search ..... 165/137, 148

[56] References Cited

U.S. PATENT DOCUMENTS

| | | | |
|---|---|---|---|
| 1,626,400 | 4/1927 | Frank | 165/137 |
| 2,184,657 | 12/1939 | Young | 165/137 X |
| 2,229,128 | 1/1941 | Reynolds | 165/137 X |
| 2,695,160 | 11/1954 | Brinen et al. | 165/137 X |
| 2,887,097 | 5/1959 | Hoffman, Sr. et al. | 165/137 X |

*Primary Examiner*—Albert W. Davis, Jr.
*Assistant Examiner*—Peggy Neils
*Attorney, Agent, or Firm*—Pravel, Gambrell, Hewitt Kimball & Krieger

[57] ABSTRACT

A radiator of the type having an upper water tank, a lower water tank, and a plurality of core radiator modules positioned between the upper and lower tanks with the use of a rubber gasket type seal, the core assembly with upper and bottom tanks secured as a unit with a pair of side frames interconnecting the tanks and core elements, the improvement comprising method and apparatus for replacing the internal module core units with a single conventional replacement core, which would include providing the replacement core in place of the modular units, providing an adaptor assembly connectably engageable onto the top face of the replacement core, the adaptor assembly having a plurality of upper nipples for accommodating the rubber gasket type seals so that the upper water tank and lower water tank can be utilized with the replacement core and the left and right side framework can re-engage the water tanks to provide the new radiator assembly utilizing the replacement core.

12 Claims, 2 Drawing Figures

RADIATOR ADAPTOR AND ASSEMBLY

BACKGROUND OF THE INVENTION

1. Field of the Invention

The apparatus of the present invention relates to internal combustion engine radiators. More particularly, the present invention relates to an adaptor assembly which can be used in the replacement of a modular-type radiator, allowing use of the upper and lower radiator tanks, and the radiator seals with the new replacement core.

2. General Background

It is well known in the art that radiators, or heat exchangers are most commonly used in internal combustion engines and must have sufficient capacity to cool the engine by the passage of air through and around a heat exchanger core which contains water that is utilized in the cooling of the engine block through heat exchange. In a conventional radiator heat exchanger assembly, water is coursed through a lengthy plurality of cooling pipes surrounded by folded metal in a single core, the radiator fan blows cool air through the core so that heat is released from the water in the pipes so that when it returns to the engine it is cooled and can pick up additional heat from the engine. This standard radiator assembly is used in most internal combustion engines, and has been known in the art for a number of years.

In a recent year, Caterpillar Tractor Company has developed a new "folded core", used in the various vehicles manufactured by Caterpillar, which is considered a departure from the conventional heavy-duty radiators which have been used since the onset of the company. In place of the one-piece conventional core, there is utilized a modular radiator comprising a number of individual core sections, each free-standing and secured at angles relative to one another, so as to present a "folded core" designation. Each modular core section is secured in position by braces from section to section and water flow is through pipes at the ends of each section and to the end water tanks. The individual folded core modules are theoretically an improvement over the conventional radiator in that there is included a trash gap between the modules and there is an increased surface area for additional cooling, together with the fact that should a break occur in a single module, the modules are easily replaceable, therefore eliminating the need for the entire replacement of the radiator itself.

However, in the practical day-to-day use of the folded core radiator module system, it has occurred that problems ensue in the core system which are sometimes insurmountable resulting in an undesirable functioning of the modular radiator system, and the need to return to a conventional radiator system. However, one of the drawbacks is that, of course, to return to the conventional system, the owner of the vehicle such as a Caterpillar tractor or harvester, which is fitted with an expensive folded core radiator, results in a great expense in replacing such an item.

SUMMARY OF THE PRESENT INVENTION

Therefore, there is a definite need for those vehicles wherein the module radiator must be replaced, that there be provided adaptor assembly which could provide the replacement of the radiator core modules themselves with the conventional replacement core, yet allow the remainder of the radiator assembly to remain in tact in the unit, so that the overall expense of a new radiator is avoided and the system can return to normal with the conventional replacement core.

In a radiator of the type having an upper water tank, a lower water tank, and a plurality of core radiator modules positioned between the upper and lower tanks with the use of a rubber gasket type seal, the core assembly with upper and bottom tanks secured as a unit with a pair of side frames interconnecting the tanks and core elements, the improvement comprising a method and apparatus for replacing the internal module core units with a single conventional replacement core, which would include providing the replacement core in place of the modular units, providing an adaptor assembly connectably engageable onto the top face of the replacement core, the adaptor assembly having a plurality of upper nipples for accommodating the rubber gasket type seals so that the upper water tank and lower water tank can be utilized with the replacement core and the left and right side framework can re-engage the water tanks to provide the new radiator assembly utilizing the replacement core.

Therefore, it is the principal object of the present invention to provide a radiator adaptor which can adapt a conventional replacement of a radiator to be utilized in place of modular core units without having to replace other components of the radiator;

It is still a further object of the present invention to provide a radiator adaptor assembly which can adapt a conventional radiator replacement core in place of modular core units, and maintain the integrity of the radiator's upper and lower tank portions and reduce cost of the replacement;

It is still a further object of the present invention to provide a system for replacing defective internal modular cores of a modular radiator system, with a conventional replacement core for the use of a radiator adaptor placed intermediate the replacement core and the tank portions of the radiator so that the replacement is easy, inexpensive, and reliable.

DETAILED DESCRIPTION OF THE PREFERRED EMBODIMENT

Figure 1:
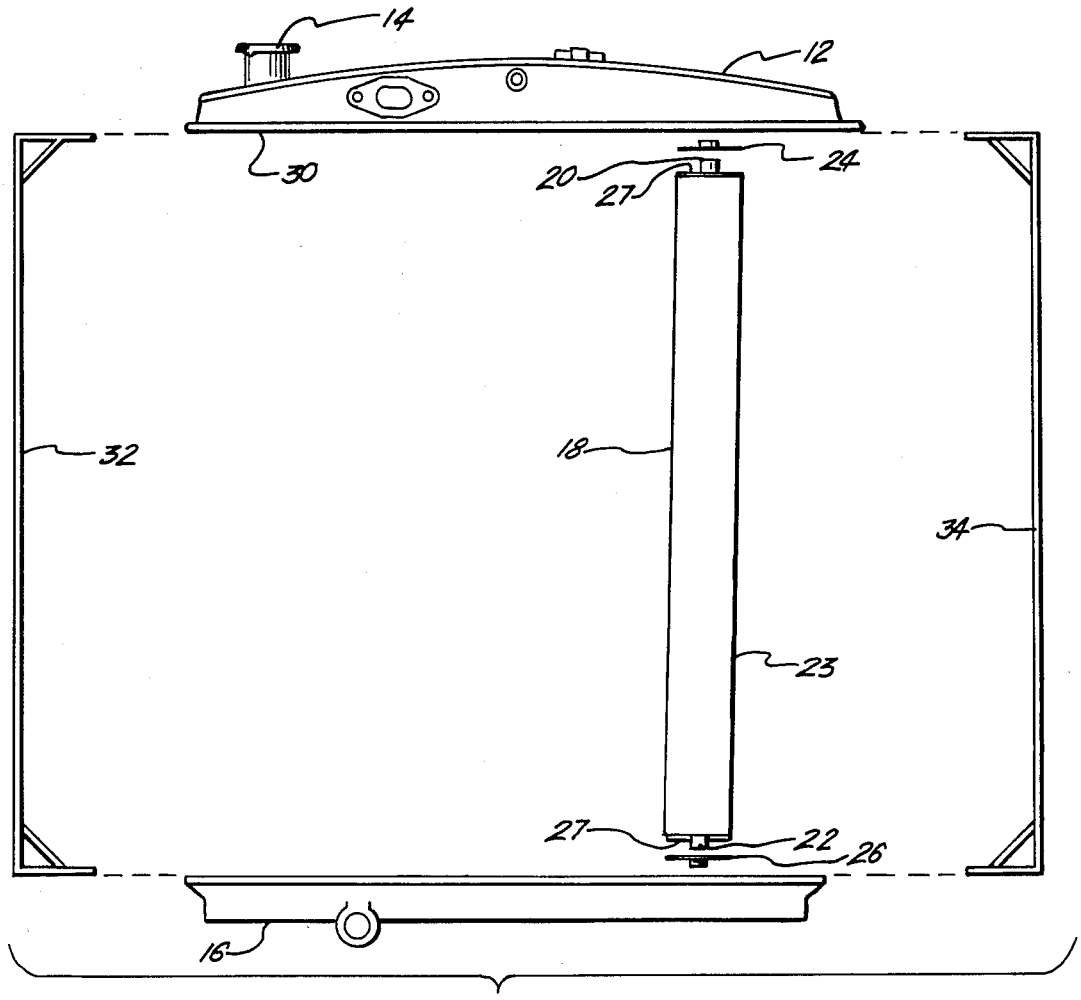
FIG. 1 illustrates an exploded view of the modular radiator core assembly of the apparatus of the present invention.
Figure 2:
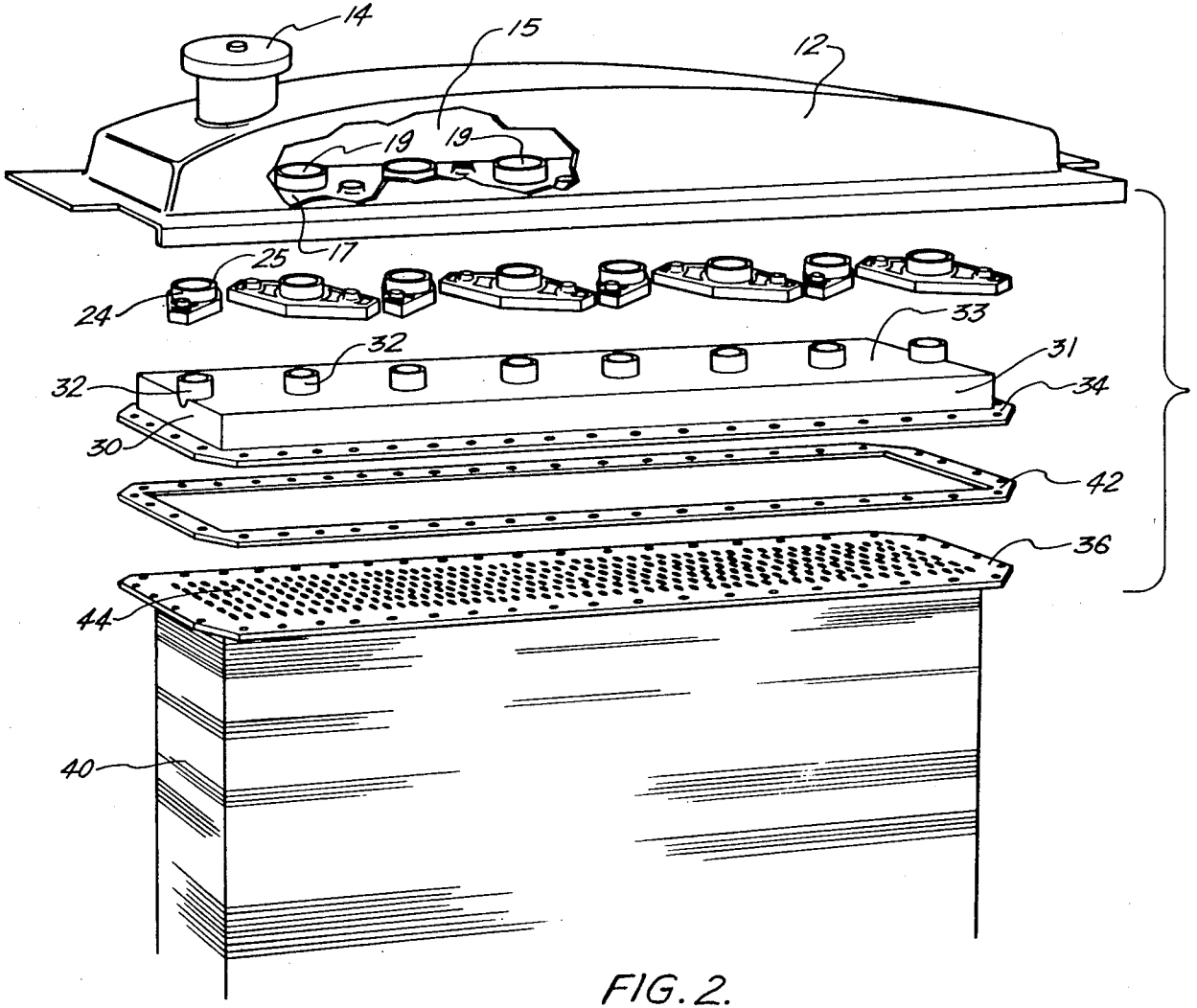
FIG. 2 represents an exploded view of preferred embodiment of the system of the present invention where in a replacement core is accommodated in a modular core radiator.

FIG. 2 illustrates the preferred embodiment of the system of the present invention, with FIG. 1 illustrating the modular core assembly wherein the replacement core will be inserted. Therefore, discussion of FIG. 1 shall proceed in order to provide background of the present invention. As seen in FIG. 1, there are provided components of what shall be termed the "modular core" radiator assembly, these components comprising an upper tank portion 12 which is for the most part a standard type water tank portion of a radiator having a fill cap 14, the top tank portion defining an area for pouring water into the system and for accommodating water flow therethrough. There is further included a lower or bottom tank portion 16, again being of a conventional type tank for receiving water flow from the top tank portion 12 through the radiator core to the bottom tank portion 16 during the circulation of the water during the cooling process.

Unlike the conventional radiator which would have a single replacement core, the radiator as illustrated in FIG. 1 would contain a plurality of radiator core units 18 which for the most part would be one of a plurality for example 16 core modules having an open-ended top portion 20, an open-ended lower portion 22, with the module comprising usually brass tubes interconnecting the top and bottom of the module with a series of steel fins 23 located along its body portion 18 for the flowing of air there through for cooling the water flowing within the brass tubes in the internal portion of the core member 18.

In order to adapt the core module 18 to the upper tank 12 and lower tank 16, there are provided upper seals 24 and lower seal 26, each upper and lower seal being constructed of a rubber type material which are positionable onto the end portion 27 of each module 18, so as to provide a fluid tight seal between each module 18 and the radiator upper tank 12 and lower tank 16. Of course, although not seen in the drawing, each upper tank 12 and lower tank 16 would have a plurality of bores in its bottom face 30 coinciding with the spouts 20 and 22 of each core member 18 so that a continuous water flow assembly is provided. As was stated earlier, approximately 16 of these cores would be positioned between upper tank 12 and lower tank 16, with the cores positioned at certain angles so as to provide air flow and trash gap spaces between each of the core members which are theoretically aided in the cooling and the functioning of the system. Also, as illustrated in FIG. 1, is a pair of left and right frame members 32 and 34 which would maintain the entire tank assembly and core assembly as a single component once assembled.

As stated earlier, in the use of the modular core radiator system, it has been found that the core modules present certain problems of overheating and other malfunctions in the radiator which are undesirable, and often result in the replacement of the radiator with a more conventional type radiator.

However, FIG. 2 illustrates the preferred embodiment of an adaptor assembly so that the core modules themselves can be replaced with a conventional replacement core. However, the other components of the system, i.e. the upper and lower seals 24 and 26, the upper and lower tanks 12 and 16 respectively and the left and right frames 32 and 34 may be maintained in the system thus reducing by a great deal the cost and time required in the replacement of the malfunctioning core modules 18 by conventional replacement core.

For purposes of illustration, FIG. 1 illustrates in detail an exploded view of the upper replacement assembly adaptor and for purposes of discussion, the components utilized in the upper tank assembly adaptor are utilized in the lower tank assembly which is not illustrated.

Seen in FIG. 1, again there is illustrated upper tank portion 12 which is the identical tank utilized in the modular core radiator system. Tank 12 again would have a fill spout 14 with the wall and top portion of tank 12 defining a water containing space 15 therewithin. In addition, there is further provided, as seen in the FIGURES, the plurality of core module seals 24, having an upward depending neck section, 25, which is insertable into the floor portion 17 of tank 12 through openings 19 in the new assembly. It should be noted that seals 24 must be maintained if the upper tank 12 and lower tank 16 are to be utilized in view of the fact that each of the upper and lower tanks 12 and 16 are provided with the series of ports 19 on the floor portion 17 having been utilized with the core modules. Again, as recalling the core modules having an upper and lower nipples 20 and 22 which were insertable into the bore 19 of the floor 17 of the radiator 12, therefore, it is required that an adaptor 30 be provided which likewise has a plurality of nipples 32 along its length. Each nipple 32 insertable into each neck portion 25 of seal 24 and likewise into bore 19 of radiator tank 12 so as to provide a fluid tight seal of water flowing through bores 19 into tank 12. Adaptor 30 would comprise a generally rectangular body portion 31 having a raised upper surface 33 where the nipples 32 are located. Adaptor 30 would be further provided with a continuous shoulder portion 34 which would conform to the upper surface 36 of a conventional radiator 40 that is being utilized to replace the core modules 18. Intermediate the adaptor 30 and the face 36 of conventional radiator core 40, there is provided a flexible gasket member 42 which is a conventional sealing member to seal the flow of fluid through the plurality of ports 44 in the upper face of the radiator 40 allowing the fluid flow to continue through throat members 32 bores 19 up through tank portion 12 and to maintain circulation through the system.

Therefore, since the object of the system is to maintain all components of the radiator system other than the individual core modules 18, it is clearly illustrated that the tank member 12 which when provided with the plurality of seals 24 must be provided with an adaptor 30 to conform on its upper portion with communication between the seals 24 and the conventional radiator 40. Therefore, on assembling the unit using the side frames 32 and 34, it is readily seen that the fluid will flow through the conventional radiator system up through the adaptor seal members 24 and into the upper tank portion and out again without having to modify any other components of the system with the use of the adaptor system.

Again, although the upper tank 12, adaptor 24, and adaptor 30 are shown, it should be made clear that such seals and adaptor would be also utilized with lower tank 16 so that tank 16 can be adapted to core 40 as is illustrated for the upper tank 12 in FIG. 1.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A radiator adaptor assembly, comprising:

a. an upper tank portion provided with a plurality of fluid flow bores through its floor portion;

b. a plurality of flexible seal members sealably insertable into the plurality of bores within the tank portion, for providing a fluid tight seal between the exterior and the tank portion;

c. a single radiator core which would replace a plurality of a modular radiator core having an upper surface provided with a plurality of fluid flow spaces there through for allowing water to flow into and out of the tank portion and the radiator core; and d. adaptor means, positioned intermediate the seal members and the radiator core for providing a fluid flow channel between the plurality of flow bores and the radiator core and the flow bores and the flow channels of the seal members inserted into the upper tank portion.

2. The apparatus in claim 1, wherein the upper tank portion accommodates the single radiator core through the use of the adaptor means so that the upper tank portion does not have to be replaced in the assembly.

3. The apparatus in claim 1, wherein the adaptor means provides a transition from the use of the plurality of modular radiator cores to a single radiator core while utilizing the same upper and lower tank portions.

4. The adaptor assembly in claim 1, further comprising means on either side of the radiator assembly for bracing the radiator together in a single functioning component.

5. An adaptor assembly for placement in a radiator of the type having upper and lower tank portions, a plurality of radiator core modules positioned intermediate the upper and lower tank portions, the upper and lower end of the modules insertable into the floor portion of the upper and lower tank portions for providing a fluid flow channel there between, and a plurality of seal members for sealably engaging the upper and lower ends of the modules to the upper and lower tank portions so that a fluid tight seal is established, the adaptor comprising:

a. a lower most surface matable with the upper surface of a replacement core;

b. an uppermost surface including a number of nipple members coinciding to the number of ports within the floor portion of the upper and lower tank portions;

the nipple members, insertable into the tank and seal members for effecting a fluid tight seal in the lower portion engaging the replacement core, so that fluid flow on the replacement core will flow into the upper and lower tank portions uninhibited.

6. The adaptor assembly in claim 5, wherein the adaptor assembly would be positioned both on the bottom and on the top of the replacement core so that the upper and lower tank portions may be utilized in the system.

7. The adaptor assembly in claim 5, wherein the assembly provides a means for transitioning from a plurality of modular core members to a single core member while maintaining use of the original upper and lower tank members.

8. The adaptor assembly in claim 5, further comprising means on either side of the radiator assembly for bracing the radiator together in a single functioning component.

9. A system for replacing core modules within a radiator, wherein the core modules are sealably engaged in the floor of the upper and lower tank portions of the radiator including sealing members between the core modules and the tank portions, the system comprising:

a. removing the core modules from the radiator system;

b. maintaining intact the upper and lower tank portions and the respective sealing members contained within the ports in the tank portions;

c. providing a conventional replacement core having upper and lower faces, each face provided with a plurality of flow bores therethrough for allowing fluid to flow through the core;

d. providing an adaptor assembly having on its upper portion a plurality of nipples for engaging the respective bores in the radiator and seal members, and having on its lower portion means for sealably engaging the faces of the replacement core, so that fluid flow through the replacement core and through the adaptor can flow into the upper and lower radiator tanks without replacing other components of the radiator system.

10. The system in claim 9, further comprising the step of initially removing brace members on either side of the radiator assembly so that the radiator assembly can be dismantled.

11. The system in claim 9, wherein the core modular are discarded in the system.

12. The system in claim 9, wherein the adaptor assembly provides a means for allowing fluid flow from a single radiator core through the plurality of fluid flow bores in the upper and lower tank portions.

* * * * *